US006308991B1

(12) United States Patent
Royer

(10) Patent No.: US 6,308,991 B1
(45) Date of Patent: Oct. 30, 2001

(54) PRINTED DOCUMENT INCLUDING BAR CODE AUTHENTICATION SYSTEM

(75) Inventor: Alain Royer, Longueuil (CA)

(73) Assignee: Oberthur Gaming Technologies, Inc., Montreal (CA)

( * ) Notice: Subject to any disclaimer, the term of this patent is extended or adjusted under 35 U.S.C. 154(b) by 0 days.

(21) Appl. No.: 08/543,636

(22) Filed: Oct. 16, 1995

(51) Int. Cl.[7] ..... B42D 15/00

(52) U.S. Cl. ..... 283/102; 235/100; 235/903; 283/462.01; 463/17

(58) Field of Search ..... 283/100, 101, 283/102, 901, 903; 235/462.01, 462.09; 463/16, 17

(56) References Cited

U.S. PATENT DOCUMENTS

| | | | | |
|---|---|---|---|---|
| 4,398,708 | * | 8/1983 | Goldman et al. | 270/18 |
| 4,591,190 | * | 5/1986 | Clark | 283/102 |
| 4,662,518 | * | 5/1987 | Chiappetta et al. | 206/449 |
| 4,725,079 | * | 2/1988 | Koza et al. | 283/903 X |
| 4,726,608 | * | 2/1988 | Walton | 283/903 X |
| 4,738,473 | * | 4/1988 | Meloni et al. | 283/903 |
| 4,787,950 | * | 11/1988 | Meloni et al. | 156/249 |
| 4,790,565 | * | 12/1988 | Steed | 283/903 X |
| 4,832,341 | * | 5/1989 | Muller et al. | 283/903 X |
| 4,858,123 | * | 8/1989 | Alexoff et al. | 364/412 |
| 4,872,707 | * | 10/1989 | Debruin | 283/903 X |
| 4,880,964 | * | 11/1989 | Donahue | 283/903 X |
| 5,074,566 | * | 12/1991 | Desbiens | 283/903 X |
| 5,098,131 | * | 3/1992 | Tucker | 283/903 X |
| 5,174,609 | * | 12/1992 | Tucker | 283/903 X |
| 5,193,854 | | 3/1993 | Borowski, Jr. et al. . | |
| 5,217,258 | * | 6/1993 | Sanderson | 283/105 |
| 5,235,167 | * | 8/1993 | Dvorkis et al. | 235/462 |
| 5,282,917 | * | 2/1994 | Danelski | 283/903 X |
| 5,286,061 | * | 2/1994 | Behm | 283/903 X |
| 5,290,033 | * | 3/1994 | Bittner et al. | 273/138 A |
| 5,346,258 | | 9/1994 | Behm et al. . | |
| 5,407,199 | * | 4/1995 | Gumina | 283/903 X |
| 5,419,592 | * | 5/1995 | Stuart | 283/903 X |
| 5,471,039 | * | 11/1995 | Irwin, Jr. et al. | 235/441 |
| 5,475,205 | * | 12/1995 | Behm et al. | 235/375 |
| 5,484,169 | * | 1/1996 | Chang et al. | 283/903 X |
| 5,489,096 | * | 2/1996 | Aron | 283/903 X |
| 5,532,046 | * | 7/1996 | Rich et al. | 283/903 X |
| 5,628,648 | | 5/1997 | Bouedec . | |

FOREIGN PATENT DOCUMENTS

| | | | |
|---|---|---|---|
| 2171054 | * | 8/1988 | (GB) . |
| 6210988 | * | 8/1994 | (JP) . |
| 8156467 | * | 6/1996 | (JP) . |

OTHER PUBLICATIONS

"ScanLine", International Gamco Inc., pp. 1–2, 1994.*

* cited by examiner

*Primary Examiner*—Will Fridie
*Assistant Examiner*—Monica Carter
(74) *Attorney, Agent, or Firm*—Watov & Kipnes, P.C.

(57) ABSTRACT

A printed document in which a bar code is imprinted on a surface thereof and entirely covered with a scratch-off layer, the removal of the scratch-off layer reveals the entire bar code thereby enabling easy authentication of the printed document.

8 Claims, 2 Drawing Sheets

PRINTED DOCUMENT INCLUDING BAR CODE AUTHENTICATION SYSTEM

FIELD OF THE INVENTION

The present invention is directed to a printed document in which a bar code is printed on the document and the bar code is entirely covered by a scratch-off layer. When the scratch-off layer is removed, the bar code may be scanned to thereby authenticate the printed document.

BACKGROUND OF THE INVENTION

State and local lotteries have become important fund raising events for the sponsoring agency. The popularity of lotteries has soared in the 1980's and continues to grow.

Those agencies charged with the administration of lotteries are acutely aware of the need to maintain the integrity of the lottery system from the printing of lottery tickets to the validation of prize winning number. Accordingly, much effort has been made to ensure that all tickets are authentic. It is generally recognized that in order for a lottery game to be successful, from the point of view of both the purchaser and the sponsor, the lottery ticket must be secure against counterfeiting, forgery and/or alteration.

Scratch-off type lottery tickets are those having at least one area over printed with an opaque latex ink. When the latex ink dries it forms a protective coating that can be scratched off to reveal pre-printed game data indicating whether or not a prize has been won.

One method of authenticating a lottery ticket is to print a bar code on the bottom side thereof. When a person claims a prize by rubbing the scratch-off layer to reveal the winning of a prize, the retail store owner can authenticate the ticket by reading the exposed bar code on the bottom side of the ticket with a scanner or other suitable device.

Bar codes currently used on lottery tickets suffer from two major disadvantages. First, the bar codes are generally one dimensional and are comprised of at least 10 and sometimes as many as 43 or more characters to be printed on the lottery ticket. The number of characters occupies a great deal of space on scratch-off lottery tickets which are typically only 4" long and 2" wide. It is because the typical bar code takes up a large amount of space on the lottery ticket, that the bar code has been printed only on the bottom side or non-game data side of the lottery ticket.

In the early 1990's there was developed a new type of bar coding system incorporating a two-dimensional bar code. The first of these systems is known as a stacked bar code in which several lines of a bar code are stacked one on top of the other. This type of bar code can be read by a laser bar-code scanner, a camera or a scanner such as those used in validation terminals. There has also been developed a two-dimensional matrix bar code comprised of dots and spaces in a two-dimensional matrix. Two dimensional bar codes enable a greater number of symbols to be set forth in a smaller area.

It would be a significant advance in the art of protecting printed documents including lottery tickets from counterfeiting if a bar code system could be employed for authenticating the printed document. A significant advantage would be obtained if the entire bar code could be hidden from view until such time as authentication is necessary. Such a system would make it more difficult to counterfeit the printed document and when the printed document was a lottery ticket provide a more secure lottery system.

It would also be a significant advantage to the overall appearance of the lottery ticket if the area occupied by the bar code authentication system could be reduced so that more of the substrate area of the printed document could be used for other purposes, such as artwork in conjunction with lottery tickets.

SUMMARY OF THE INVENTION

The present invention is directed to the authentication of printed documents and especially lottery tickets. The printed document is provided with a bar code covered by a scratch-off layer which is placed over the entire bar code. The bar code is therefore hidden from view until the scratch-off layer is removed. In one embodiment of the invention, the bar code is covered by a scratch-off layer which is removed only by authorized personnel. Therefore, in accordance with one aspect of the invention, tampering with the scratch-off layer itself at least raises a question as to whether the printed document is authentic.

In another embodiment of the invention, the bar code is imprinted in the same area occupied by the game data which together are covered by a scratch-off layer. In this embodiment the purchaser of the lottery ticket is permitted to remove the scratch-off layer. Authentication of the ticket is then made by scanning the exposed bar code.

In accordance with another aspect of the invention, the area occupied by the bar code can be minimized so that the location of the bar code is not restricted. Thus, the bar code and accompanying scratch-off layer can be either on the back of the ticket or on the front of the ticket. In the past, bar codes were limited to the back of the ticket because they occupied a relatively large area, thereby severely hampering the imprinting of game data, art work and other information on the front of the ticket.

In particular, the present invention is directed to a printed document such as a lottery ticket comprising:

(a) a substrate;

(b) bar code authentication means imprinted on the substrate; and (c) a scratch-off layer placed over the entire bar code authentication means and adapted to be removed to reveal the bar code authentication means so that the printed document can be authenticated.

The present invention also concerns a method for authenticating a printed document in which the scratch-off layer is removed to reveal the entire bar code authentication means. The bar code authentication means can be read and compared with a predetermined list of bar code identification means in the form of numbers and/or symbols such that if the bar code identification means appears on the predetermined list, the printed document is authentic. If the bar code is spaced apart from the game data and covered with a separate scratch-off layer, then removal of the scratch-off layer itself constitutes a mode of authentication of the lottery ticket.

BRIEF DESCRIPTION OF THE DRAWINGS

The following drawings in which like reference characters indicated like parts are illustrative of embodiments of the invention and are not intended to limit the invention as encompassed by the claims forming part of the application.

DETAILED DESCRIPTION OF THE INVENTION

The present invention is generally directed to printed documents which have a bar code authentication means completely covered by a scratch-off layer. Because the bar code is not exposed to the public, counterfeiting and tampering with the bar code is prevented or at least inhibited.

Figure 1:
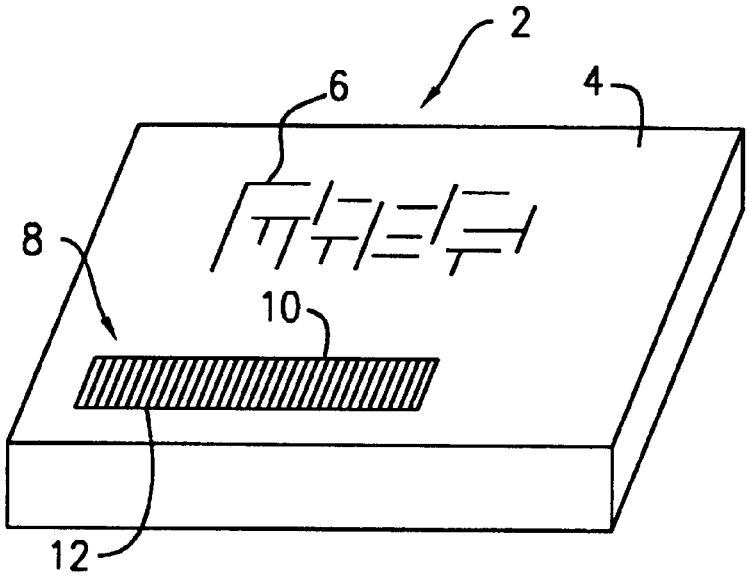
(PRIOR ART) FIG. 1
FIG. 1 is a perspective view of the bottom side of a printed document in the form of a lottery ticket employing a bar code in accordance with the prior art.

Bar codes have been previously used to authenticate lottery tickets. Referring to FIG. 1 there is shown a prior art lottery ticket 2 shown with its bottom side 4 facing upwards. The surface 4 contains instructional material generally designated by the numeral 6 for the ticket and a bar code display 8 containing a plurality of symbols such as bars 10 and spaces 12 capable of identifying an authentic ticket. As shown in the prior art ticket of FIG. 1, the bar code is always exposed, from the time it is sold to the time it is presented to a lottery sponsor for authentication. Because the lottery ticket is exposed, a counterfeiter may alter the bar code or attach a new bar code for the purposes of collecting a prize on a counterfeit lottery ticket.

In accordance with the present invention, a bar code is used for authentication purposes but, unlike prior art devices, the entire bar code is covered with a scratch-off layer. The bar code may be covered by a separate scratch-off layer or by the same scratch-off layer used to cover the game data. Only when the scratch-off layer is removed is the bar code revealed. In the case of separate scratch-off layers, the lottery sponsor may scrutinize any ticket that is presented for collection if the scratch-off layer has been altered or removed. If a single scratch-off layer is used, any attempt to alter the bar code will likely result in an effect on the game data which will also likely be scrutinized by a lottery sponsor.

Figure 2:
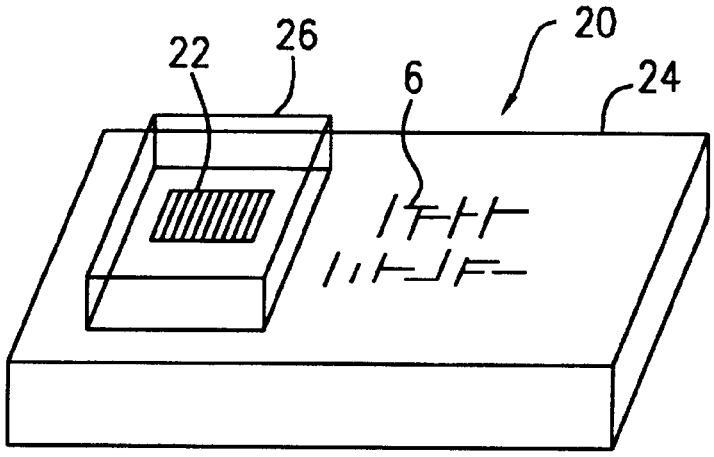
FIG. 2 is a perspective view of one embodiment of a lottery ticket with a bar code covered by a scratch-off layer in accordance with the present invention.

Referring specifically to FIG. 2 there is shown a printed document 20 in the form of a lottery ticket in accordance with the present invention which has a bar code 22 imprinted on a surface 24 of the printed document. It will be understood that the surface 24 of the printed document 20 may be the top side or the bottom side of the printed document.

The bar code 22 is covered in its entirety by a scratch-off layer 26. Accordingly, when the printed document (lottery ticket) is sold, the bar code can not be seen by the purchaser of the lottery ticket. It is only when the scratch-off layer is removed by the lottery sponsor that the bar code becomes visible and can be read by a optical scanner or the like. If the bar code is presented with the scratch-off layer removed, the sponsor may reject the ticket. Thus, it is the absence of removal or alteration of the scratch-off layer which itself assists in determining whether a lottery ticket is authentic.

Figure 3:
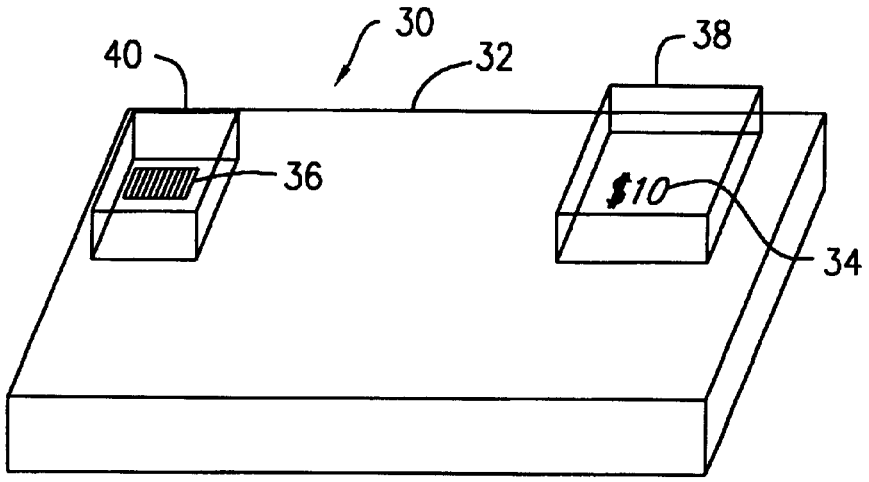
FIG. 3 is a perspective view of another embodiment of the invention in the form of a lottery ticket with a scratch-off layer covering a bar code which is separated from another scratch-off layer covering game data.

The bar code and its overlaying scratch-off layer can be printed on the front side of the lottery ticket along with the game data which is covered by a separate scratch-off layer. Referring to FIG. 3, there is shown a lottery ticket 30 having a top side 32 having imprinted thereon game data represented by numeral 34 and a bar code 36. Each of the game data 34 and bar code 36 are covered by separate scratch-off layers 38 and 40, respectively.

In this embodiment of the invention, the bar code remains hidden until the scratch-off layer is removed by a lottery sponsor to reveal the bar code. The bar code is then read by a scanner and if it is a member of a predetermined list, then the lottery ticket is authenticated. Counterfeiting by replacement of alteration of the bar code is determined because in order to engage in such activity the scratch-off layer would have to be removed.

Figure 4:
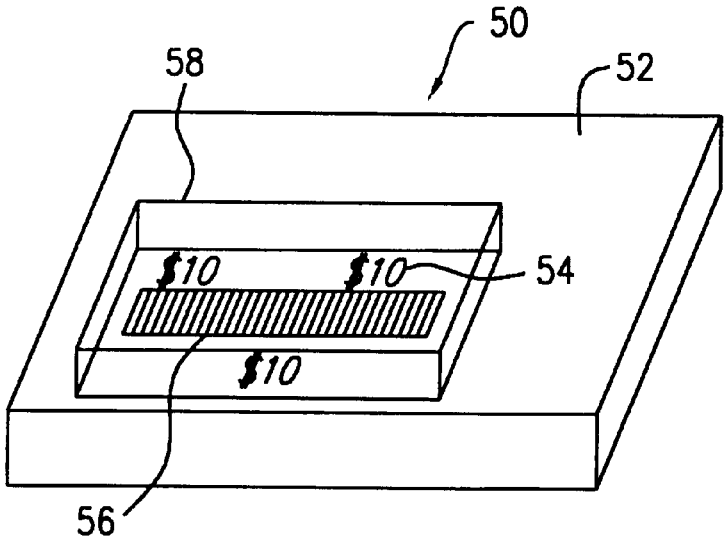
FIG. 4 is a perspective view of a further embodiment of the invention in the form of a lottery ticket with a bar code and game data covered by a single scratch-off layer.

In another embodiment of the invention, a single scratch-off layer covers both the game data and the bar code. Referring to FIG. 4 there is shown a printed document 50 in the form of a lottery ticket having a top side 52 having imprinted thereon game data 54 and a bar code 56, each covered by a single scratch-off layer 58.

The game data bar code may be printed anywhere in the designated area covered by the scratch-off layer so long as each can be read by the human eye and an optical scanner or the like, respectively. Thus, the game data 54 can be imprinted around the bar code as shown specifically in FIG. 4 or superimposed thereon. All that is required is that the purchaser of the ticket be able to read the game data to see if a prize has been won. Of course, the lottery sponsor must be able to read the bar code to authenticate the lottery ticket.

The type of bar codes that can be used in the present invention is unlimited. Both one dimensional bar codes and two dimensional bar codes can be used. Two dimension bar codes are preferred because they provide the greatest number of symbols in the smallest area. Examples of one dimensional bar codes include the Universal Product Code (UPC), Code 39, interleaved 2 of 5 Code, Code 93 and Code 128. Examples of two dimensional bar codes are the stacked bar code containing several lines of bar code stacked one upon the other. Examples include Code 16K, Code 49, MLC-D2 and Code PDF417.

Another two dimensional bar code comprises a matrix code comprised of dots and spaces in a two dimensional matrix. Examples of two dimensional matrix codes are code one, vericode code and data matrix code.

What is claimed is:

1. A printed document comprising:

(a) a substrate;

(b) a play area on the substrate comprising printed indicia covered by a removable scratch-off coating, said printed indicia when present in a desired format may result in a prize being won;

(c) a non-play area on the substrate spaced apart from the printed indicia of the play area and including an authentication means comprising a bar code, said bar code containing all information necessary to authenticate the printed document and being covered by a removable scratch-off coating, said bar code, after removal of the scratch-off coating, being readable by a reading device when placed in contact therewith by an agent of the printed document, such that when the bar code is read by the reading device, the printed document may be authenticated without the input of additional information provided by the agent of the printed document or directly from the printed document, wherein the absence or alteration of the scratch-off coating covering the bar code may be a determining factor as to whether the printed document is authentic.

2. The printed document of claim 1 wherein the printed indicia and the bar code are covered by the same removable scratch-off coating.

3. The printed document of claim 1 wherein the printed indicia and the bar code are covered by separate removable scratch-off coatings.

4. The printed document of claim 1 wherein the game data is printed around the bar code.

5. The printed document of claim 1 wherein the printed indicia and the bar code are on opposed sides of the printed document.

6. The printed document of claim 1 wherein the printed indicia and the bar code are on the same side of the printed document.

7. The printed document of claim 1 Wherein the bar code is a two dimensional bar code.

8. The printed document of claim 1 wherein the absence or alternation of the scratch-off coating covering the bar code is a determining factor as to whether the printed document is authentic.

* * * * *